US007819519B2

(12) United States Patent
Eve

(10) Patent No.: US 7,819,519 B2
(45) Date of Patent: Oct. 26, 2010

(54) PRINTING MOVING SUBSTRATES

(75) Inventor: Richard William Eve, Cambridge (GB)

(73) Assignee: Inca Digital Printers Limited (GB)

( * ) Notice: Subject to any disclaimer, the term of this patent is extended or adjusted under 35 U.S.C. 154(b) by 0 days.

(21) Appl. No.: 10/582,453

(22) PCT Filed: Dec. 10, 2004

(86) PCT No.: PCT/GB2004/005129

§ 371 (c)(1),
(2), (4) Date: Jun. 14, 2007

(87) PCT Pub. No.: WO2005/058603

PCT Pub. Date: Jun. 30, 2005

(65) Prior Publication Data

US 2007/0296791 A1 Dec. 27, 2007

(30) Foreign Application Priority Data

Dec. 12, 2003 (GB) ..... 0328861.0

(51) Int. Cl.
*B41J 2/01* (2006.01)

(52) U.S. Cl. ..... 347/104; 271/96; 271/194; 347/101; 347/102; 347/126; 347/171; 346/134; 438/19; 438/599

(58) Field of Classification Search ..... None
See application file for complete search history.

(56) References Cited

U.S. PATENT DOCUMENTS 4,463,361 A 7/1984 Koumura et al.
5,255,020 A * 10/1993 Martin et al. ..... 347/8
6,168,269 B1 1/2001 Rasmussen et al.
6,179,285 B1 * 1/2001 Teumer et al. ..... 271/194
6,254,081 B1 7/2001 Rasmussen et al.
6,416,176 B1 * 7/2002 Yasui et al. ..... 347/104
6,585,347 B1 7/2003 Johnson et al.

(Continued)

FOREIGN PATENT DOCUMENTS

CN 1407927 4/2003

(Continued)

OTHER PUBLICATIONS

International Search Report and Written Opinion of ISA for PCT/GB2004/005129, dated Apr. 4, 2005; ISA/EP.

(Continued)

*Primary Examiner*—Matthew Luu
*Assistant Examiner*—John P Zimmermann
(74) *Attorney, Agent, or Firm*—Harness, Dickey & Pierce, P.L.C.

(57) ABSTRACT

An ink jet printing apparatus for printing on a moving substrate (16) is described. The apparatus comprises ink jet printheads (4) for printing on a surface of the substrate, a plurality of rollers (12, 14) arranged to move the substrate (16) relative to the printheads (4), and a pressure source (22). The pressure source (22) is arranged to apply a negative gauge pressure (32) to the substrate (16). The application of the pressure can hold the substrate flat and can reduce undesired movement of the substrate relative to the rollers (12, 14). The apparatus allows for high quality full colour images to be printed onto substrates in a single pass using an ink jet printer.

21 Claims, 8 Drawing Sheets

U.S. PATENT DOCUMENTS

| | | | | |
|---|---|---|---|---|
| 6,834,949 | B2 * | 12/2004 | Greive | 347/104 |
| 2002/0018097 | A1 | 2/2002 | Kitahara et al. | |
| 2002/0057321 | A1 * | 5/2002 | Rasmussen et al. | 347/101 |
| 2003/0016983 | A1 * | 1/2003 | Baldwin-Garcia | 400/149 |
| 2005/0035990 | A1 * | 2/2005 | Wotton et al. | 347/22 |

FOREIGN PATENT DOCUMENTS

| | | | |
|---|---|---|---|
| GB | 2343415 | | 5/2000 |
| GB | 2 380 163 | A | 4/2003 |
| GB | 2 384 931 | A | 8/2003 |
| JP | 58-059869 | | 4/1983 |
| JP | 05-278281 | | 10/1993 |
| JP | 10-315551 | A | 12/1998 |
| JP | 2001-335183 | A | 12/2001 |
| JP | 2002-137844 | | 5/2002 |
| JP | 2003-191552 | A | 7/2003 |
| JP | 2003-285959 | A | 10/2003 |
| WO | 01-64444 | | 9/2001 |

OTHER PUBLICATIONS

Search Report for GB 0328861.0, dated May 24, 2004.
Communication from PCT IB re: related application.

* cited by examiner

PRINTING MOVING SUBSTRATES

The invention relates to printing. The invention finds particular, but not exclusive, application to printing onto a moving substrate. Preferred examples described relate to ink jet printing, and in particular to a transport system and method for moving a substrate in an ink jet printer.

Examples are described below relating to single pass ink jet printing: the substrate makes only one passage past the printhead arrangement.

Ink jet printing offers certain advantages over other printing methods as it can allow rapid changeover of images. However, there can be difficulties in producing high quality images.

Conventional printing machines (for example offset lithography and flexography) can print full colour images with high quality onto both continuous webs and sheets, but there are some difficulties in achieving this using existing ink jet printing techniques.

In an ink jet printing process, an array of droplets of, for example, ink is deposited onto the surface of a substrate in a pattern to form the required image. The droplets of ink are typically emitted from an array of nozzles of an ink jet printhead. It is generally necessary for there to be relative movement between the ink jet printhead and the substrate during the printing procedure for the whole of the required image to be printed onto the substrate. In some arrangements, this movement is carried out while the ink is being emitted from the nozzles of the printhead; alternatively, or in addition, printing may be paused while the movement occurs. Where there is relative movement between the printhead and the substrate during the printing of the image, errors in registration may occur which can lead to reduction in image quality.

This is a particular problem where halftone images are being printed. Very small errors in registration between colours can produce strong colour errors in halftone printing through moire effects. Moire effects are patterns, for example a herringbone pattern, which can arise when two or more geometrical patterns, such as grids, are superimposed. In ink jet printing, they can arise where two or more grids of printed droplets, for example for the different colours of a colour image, are not correctly registered. This can also be a problem for printing images of a single colour where several print heads are used spaced in the print direction.

In conventional printing, this can be controlled by rotating the screens for the different colours being printed, which produces small-sized moire rings that are considered not visually objectionable. This type of technique is not, however, possible in ink jet devices, in particular for single pass arrangements, because the arrays of nozzles produce the image directly from a single movement of the substrate.

Thus for ink jet printing, it is thought necessary to control the lateral relative movement of the substrate and the printheads to a high precision, in particular for single pass printing. Typically, lateral movement of 20% of the dot pitch of the printed image can result in unacceptable banding in the print. Thus for an image having a resolution of 200 dpi, errors of the order of 0.001 inches can produce banding.

Particular problems can occur when the substrate is moved during the printing process because there can be unwanted movement of the substrate which can give rise to reduction in print quality as a result of registration errors.

The substrates to be printed, for example rigid sheets, are often transported on conveyor belts. However, it is difficult to construct conveyor belt systems that give the required precision of movement, and slippage of the substrate on the conveyor belt can occur.

Some existing ink jet printers use vacuum in combination with conveyor belts and rollers to transport a substrate to be printed, see for example FIGS. 9*a* and 9*b* of JP 10-315551. Such systems are designed to index the substrate between the printing of print swathes, and to hold the substrate while ink is emitted by the printhead. A vacuum may be used to hold the substrate against a platen or belt, to maintain a uniform gap between the printheads and the surface of the substrate. Linear speed of movement of the substrate is low, typically 0.1 m/s, since the index distance between swathes is small, typically 1 cm. Such systems are able only to handle flexible substrates such as paper. Single pass printing at speeds over 1 m/s on rigid materials such as corrugated board requires a different approach.

Aspects of the present invention seek to mitigate one or more problems identified above.

According to a first aspect of the invention, there is provided an ink jet printing apparatus for printing on a moving substrate, the printer comprising: a plurality of ink jet printheads for emitting ink towards a surface of the substrate wherein the printheads are adapted to be stationary while emitting ink; a plurality of rollers arranged to move the substrate relative to the printheads; and a pressure source wherein the pressure source is arranged to apply a negative gauge pressure to the substrate, preferably to hold the substrate to the rollers. The application of the pressure preferably helps to hold the substrate flat, and/or to reduce undesired movement of the substrate relative to the rollers.

Preferably the negative gauge pressure provides a 'hold-down' effect on the substrate which increases its traction with the rollers, thereby reducing undesired movement of the substrate.

By applying the negative gauge pressure, slipping of the substrate on the rollers may be reduced or eliminated. Such slippage might otherwise occur, for example in the event of sudden changes in movement of the rollers, for example where the rollers are driven by a step motor. This reduction of slippage is of particular benefit for substrates having a low coefficient of friction, for example a substrate comprising a plastics material such as polypropylene.

Preferably the substrate is transported directly on the rollers, for example such that the substrate directly contacts the rollers.

The application of a vacuum also can act to flatten the substrate. In this way, a controlled, gap (for example about 2 mm) can be maintained between the printheads and the substrate surface. If the substrate were not flattened, it may impact with the printheads, smearing the ink and damaging the printheads.

The 'hold-down' effect may also reduce the effect of undesirable external forces on the substrate, particularly if the substrate is susceptible to movement caused by nearby air currents, for example if it is of a low mass.

The provision of a 'hold down' effect by application of the negative gauge pressure is also advantageous because the effect can be provided without particular consideration of the substrate edge profile: the arrangement can be used to print on a variety of shapes and sizes of substrate with little or no alterations required to the arrangement.

Preferably the substrate is substantially flat.

Rollers are advantageous because they can, for example, be made to a high accuracy and mounted on bearings accurately so as to give little unwanted lateral movement. It is also possible to ensure that the rollers turn at the same speed to reduce the risk of loss of traction of a roller with the substrate, which may result in twisting and hence lateral movement of the substrate.

Preferably the rollers are arranged to support the substrate on the upper surfaces of the rollers. Conveniently, the rollers are generally cylindrical. The outer surface of the roller may be shaped as described below. They are preferably arranged substantially parallel to each other and, as they rotate, they move the substrate in a generally linear direction. Rollers are particularly suitable because such rollers can be used both to support the substrate (which can for example be simply placed on top of the rollers), and to move the substrate in a desired direction, for example, by rotating the rollers synchronously or otherwise, the rotation providing movement of the substrate.

Alternatively, or in addition, the substrate may be held in other orientations during printing. The application of the vacuum allows a variety of different orientations so that for example the substrate may be held from above, with the printheads directed upwards at the underside of the substrate, or the rollers may form a vertical face with the substrate travelling vertically or horizontally.

Preferably the plurality of printheads includes more than one line of print nozzles. The printheads may be provided separately or may be combined into one or more printhead arrangement.

Preferably the apparatus is adapted to print onto the surfaces of a plurality of discrete substrates. Preferably, the apparatus is adapted to print onto sheets of material. Such an apparatus is to be contrasted with a printer which is adapted to print onto, for example, a continuous web of material.

While the apparatus is preferably adapted to print onto sheets of material, it will be appreciated that the substrate might have a different form. Generally, any shape of substrate could be transported in the printer using methods described herein; the method is particularly applicable to substrates having at least one flat area on its surface, to which the negative gauge pressure can be applied.

Accurate positioning of discrete sheets of material is, using conventional methods, particularly difficult to maintain and the "hold down" effect is of particular benefit in such cases.

The rollers may be made of any suitable material, and may further include a high friction outer surface to increase the friction between the roller and the substrate.

Preferably the apparatus includes at least three rollers arranged to move the substrate relative to the printheads. It has been found that in many applications at least three rollers are required to provide adequate control of the movement of the substrate. The number of rollers used and their size will depend on the size shape and weight of the substrate to be moved by the rollers. It is thought that at least four, more preferably at least five rollers would be used. In a preferred example, ten rollers are used.

Preferably the rollers are arranged having an axis of rotation substantially perpendicular to the direction of printing. Preferably the rollers are arranged adjacent each other, preferably directly adjacent each other, preferably in the direction of printing. Preferably the direction of printing corresponds to the direction of movement of the substrate.

The combined use of a vacuum 'hold down' and rollers for moving the substrate can provide for the movement of the substrate to be closely controlled, thereby increasing the accuracy at which droplets can be printed on the substrate, thereby resulting in a higher quality image which has reduced banding defects. The apparatus preferably further includes a controller adapted to control the movement of the rollers. Preferably the controller is adapted to control the relative movement of the substrate and the printheads.

Preferably, the arrangement is such that the relative displacement of the substrate, orthogonal to the direction of printing, is within a predetermined tolerance.

It will be understood that the velocity of the rollers is preferably carefully controlled. Differences in the velocity of the rollers relative to each other can cause, in the substrate plane, two substrate traction surfaces (motive surfaces) moving at different linear speeds. This can result in 'twisting' of the substrate as it moves along the rollers. This is preferably reduced by controlling the rotation of the rollers such that the difference in speeds is zero or near to it.

Preferably a roller is mounted substantially parallel to an adjacent roller, preferably such that the angle of the adjacent rollers is not more than 6 milliradians from parallel preferably not more than 4, more preferably not more than 2 milliradians.

Preferably the rollers are rotatable and preferably the apparatus is adapted to control the rotation such that the peripheral speeds (preferably the speed of an outer surface of the roller holding the substrate) of adjacent rollers is within 1%, preferably within 0.5%, preferably within 0.3%.

Control of substrate movement in the orthogonal, or lateral direction to the direction of printing, is particularly important because even small print registration errors in this direction are easily visible.

Preferably, the predetermined tolerance is chosen in dependence on the perceived acceptable image quality and in dependence on the nozzle pitch of a printhead in the relevant direction.

Preferably, the relative displacement is less than 30 percent of the dot pitch of the printed image, preferably less than 20 percent of the pitch, more preferably less than 15 percent of the pitch, most preferably less than 10 percent of the pitch.

Preferably the negative gauge pressure is applied to the substrate in a region between adjacent rollers. Such an arrangement can provide improved hold down of the substrate.

Preferably the negative gauge pressure is applied to the substrate only in the region between the rollers. Preferably the negative gauge pressure is not applied through the rollers themselves, for example by having perforations provided in the rollers.

The amount of vacuum applied to the substrate will be chosen having regard to the nature of the substrate and the required print quality. It will be appreciated that a high pressure would give better hold down of the substrate and therefore potentially less slip and better print quality, but at greater cost and at increased risk of causing damage to the substrate, for example as a result of bending of the substrate.

Preferably the apparatus further includes an element arranged between the rollers adjacent the substrate; preferably the element is arranged to restrict the airflow between the rollers.

The use of a masking element can throttle the airflow through the gap between the rollers, thus reducing the size of vacuum pump required. Also, this can avoid excessive airflow adjacent the substrate which could disrupt the jets of ink droplets emitted from the printheads. Also, the pressure can be applied more quickly to the substrate.

In the case of porous substrates, a masking element is particularly desirable as it concentrates the effect of the vacuum away from the middle section of the substrate between the rollers of the substrate to the area of the substrate near the rollers, where the vacuum effect is required.

Alternatively, or in addition the element is arranged to reduce deformation of the substrate between the rollers. This may comprise a different element from the masking element, or may be the same element, providing more than one function.

Where the substrate is mounted on the rollers, there will be an area between the rollers where there is no contact between the rollers and the substrate. This is preferably the area to which the vacuum is applied. Where the substrate is not substantially rigid, the application of the vacuum might cause deformation of the substrate in this region. The element may be arranged to support the substrate as it passes between the rollers. This is of particular benefit where the substrate is porous. The support element can also, it will be understood, have the additional effect of restricting the air flow as described above.

However, in other arrangements, preferably there is a gap between the substrate and the element. This is desirable particularly where the substrate moves quickly through the apparatus.

Preferably the apparatus further includes a guide for guiding a leading edge of the substrate. This may be provided as a function of the element described above. Preferably the guide is positioned between the rollers. The element described above may also provide a guide surface for guiding the advancing substrate. Such a guide can also help to prevent material becoming wrapped around the rollers by guiding the leading edge of the substrate.

Preferably the element and/or guide comprises a hard material having a low friction surface.

It will be understood that a wide range of substrates could be printed using an apparatus described herein. The apparatus is of particular use where the substrate comprises a stiff or rigid material. Such a material is less likely to deform or be damaged by the action of the vacuum and/or by passage over the rollers. Preferably the substrate comprises a substantially rigid material. In preferred arrangements, the substrate comprises a substantially flat and rigid sheet. The substrate may comprise one or more of paper, card, wood, metal or plastics or ceramic material.

Where rigid substrates are to be printed, preferably the outside surfaces of the rollers comprise deformable material, for example an elastomer.

Preferably the arrangement is such that the substrate is mounted, during printing, on a deformable surface. In this way, when the vacuum is applied, the hold down of the substrate is improved since the deformable surface can conform to the surface of the substrate. The outer surfaces of the rollers may comprise an elastomer.

Where less rigid substrates are to be printed, a roller having a shaped outer surface can be used, preferably with a corresponding guide, to reduce the risk of the substrate being caught in the gap between the guide and the roller.

Preferably the leading edge of the guide element is not straight.

Preferably the arrangement is such that no roller is required which contacts the surface of the substrate being printed. This arrangement is possible due to the application of the negative gauge pressure as described herein.

Preferably the printer is adapted to print the substrate in a single pass. Preferably the printer prints the desired image with one single movement of the substrate through the printer. Printing in a single pass can dramatically reduce the printing time compared with a multi-pass print. However, such a print technique requires particularly high accuracy in the maintenance of the position of the substrate if print defects are to be minimised.

For multipass printing, the substrate would usually be mounted on a reciprocating table; the trajectory of the table being controlled very precisely. Such an arrangement would not be practical for single pass printing since a long time would be taken loading and unloading the table.

Preferably the printheads are fixed during printing. In preferred arrangements the printheads are fixed relative to the rollers. This can provide a reference point for controlling the movement of the substrate as it moves along the rollers. Using fixed printheads again requires a particularly high accuracy in the maintenance of the position of the substrate if print defects are to be minimised. Any unplanned movement of the substrate, whilst moving relative to the stationary printheads during the time interval between droplet emission, is likely to cause a following droplet to be deposited away from its intended destination, thus resulting in incorrect registration for the following droplet. If the registration of the substrate continues to be incorrect, the pattern printed by the inkjet printheads would be incorrectly registered.

The printheads are stationary while the ink is emitted; in some preferred examples, the printheads do not move during the printing of the substrate. In some examples the printheads do not move at all in the plane of the surface to be printed, but height adjustments can be made.

Preferably the substrate is moved during the emission of ink. Preferably the speed of movement of the substrate relative to the printheads is greater than 0.5 m/s, preferably greater than 1 m/s, preferably in the print direction. Preferably the substrate is moved at a speed greater than 0.5 m/s, preferably greater than 1 m/s.

Preferably the system is adapted to print a colour image. The system may be adapted to print a halftone image. For such images, correct placement of the droplets on the substrate is more critical if acceptable print quality is to be obtained. In particular, for colour, the colour image is built up by printing droplets of different colours sequentially over the area to be printed; if there is an unwanted movement of the substrate between the printing of the different colours there can be a dramatic reduction in image quality. The same effect can occur if multiple printheads are used to print a single colour, for instance to increase addressability.

The use of several printheads can give a high quality printed image. It will be seen, however, that if there is an unwanted movement of the substrate between the printing by the different printheads, there can be a dramatic reduction in image quality.

Preferably the apparatus includes a drop-on-demand printhead.

Preferably the apparatus is adapted to print an image having a resolution of greater than 120 dpi. Preferably the resolution of the printed image is greater than 120 dpi in a direction orthogonal the direction of movement for printing (print direction). Preferably the resolution is greater than 120 dpi in the print direction. Preferably the resolution is greater than 150 dpi.

A further aspect of the invention provides a transport device for moving a substrate past printheads in an ink jet printer, the device comprising: a plurality of rollers arranged to move the substrate relative to the printheads; and a pressure source wherein the pressure source is arranged to apply a negative gauge pressure to hold the substrate to the rollers.

A further aspect of the invention provides a method of printing a substrate in an ink j et printer comprising a plurality of printheads, a plurality of rollers and a pressure source, the method comprising the steps of: moving the substrate on the rollers relative to the printheads; and applying a negative gauge pressure to the substrate to hold the substrate to the rollers, wherein the printheads are stationary during emission of ink towards the substrate. Preferably the substrate is printed in a single pass.

The invention further provides a substrate printed using a printer as described herein and/or using a method as described herein.

Further aspects of the invention provide an apparatus being substantially as described herein having reference to and as illustrated in the accompanying figures and a method being substantially as described herein having reference to the accompanying figures.

Features of one aspect of the invention may be provided with features of other aspects in any appropriate combination.

Preferred features of the present invention will now be described, purely by way of example, with reference to the accompanying drawings, in which.

Figure 1:
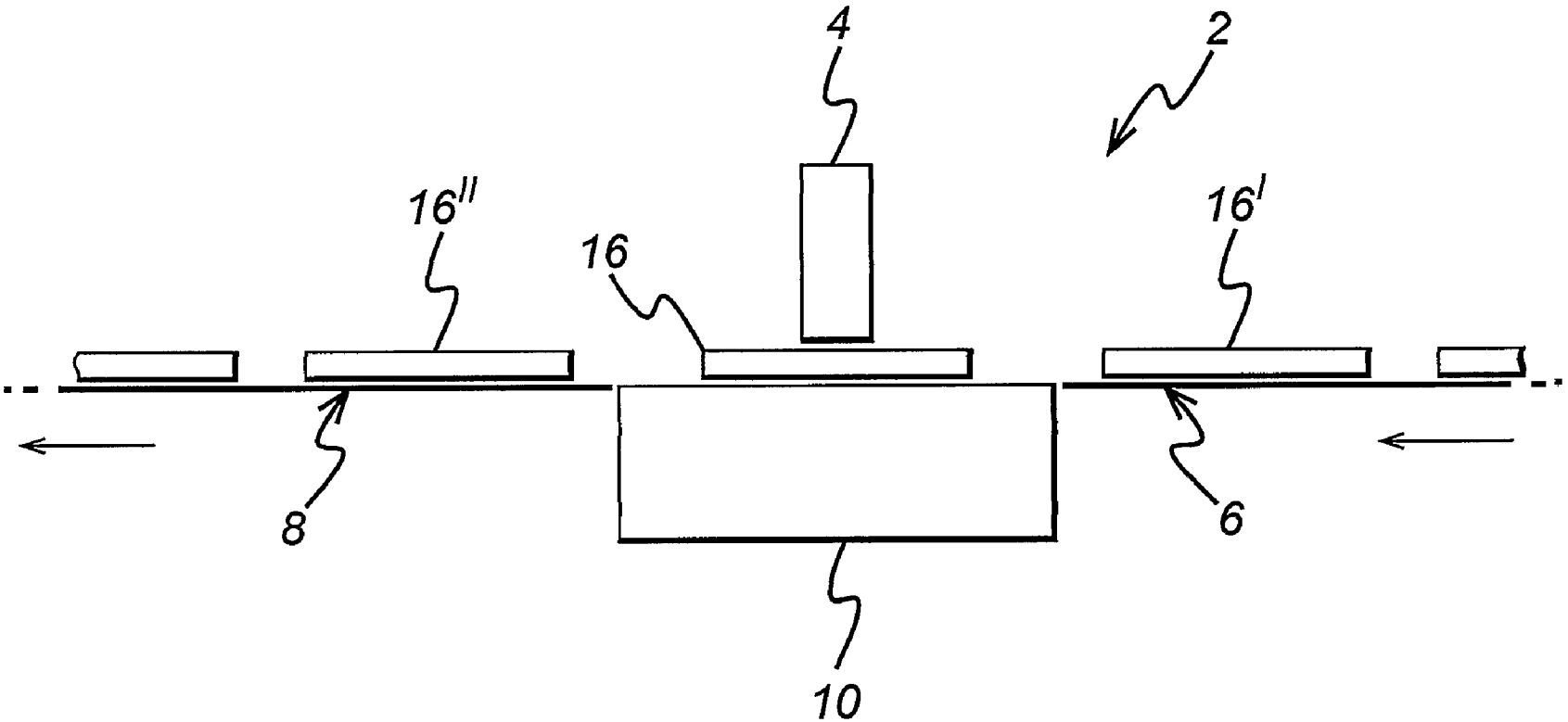
FIG. 1 shows schematically an ink jet printer including a transport system.

FIG. 1 illustrates schematically an ink jet printer 2 having a fixed printhead arrangement 4 for printing droplets of ink onto a succession of rigid sheets of substrate 16, 16', 16" as they are moved through the printer past the printhead arrangement 4 by a transport system 10. The substrate moves through the printer past the printhead arrangement 4 only once for single pass printing.

A first conveyor 6 moves an unprinted substrate 16' towards the transport system 10; a second conveyor 8 moves the printed substrate 16" away from the transport system. The conveyors 6, 8 comprise conveyor belts, although other arrangements could be used. Conventional methods may be used for loading the substrates on and off the conveyors 6, 8.

The transport system 10 is arranged to provide accurate movement of the substrate 16 past the printhead arrangement 4. The length of the transport system 10 in the direction of printing and the width of the transport system perpendicular to the direction of printing are preferably chosen so that the whole of the substrate 16 is supported by the transport system 10 while the image is being printed.

The printhead arrangement 4 comprises four sets of printheads, each set printing a different colour selected from cyan, magenta, yellow and black to build up a full colour image on the substrate. The printhead arrangement 4 does not move during the printing operation. However, the printheads may be moved up and down to allow for different thickness of substrate.

In this example, the substrate 16 comprises a flat rectangular sheet of corrugated cardboard having a thickness of about 2 mm. The arrangement described can, however, be used to print onto a wide variety of types of substrate, for example carton board, and sheets of plastics material, for example PVC, and onto different shapes of substrate.

Figure 2:
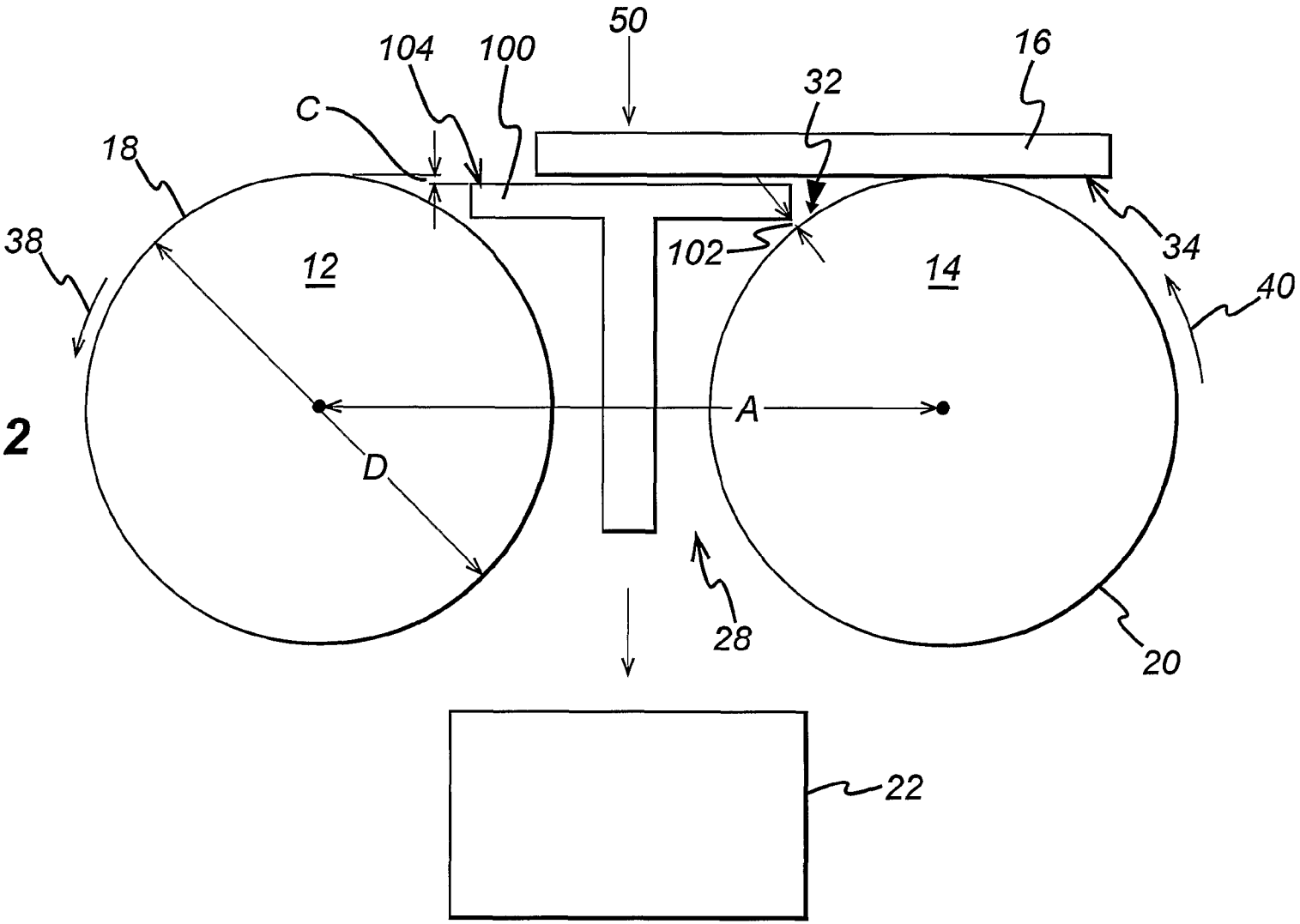
FIG. 2 illustrates a part of the transport system of FIG. 1.
Figure 3:
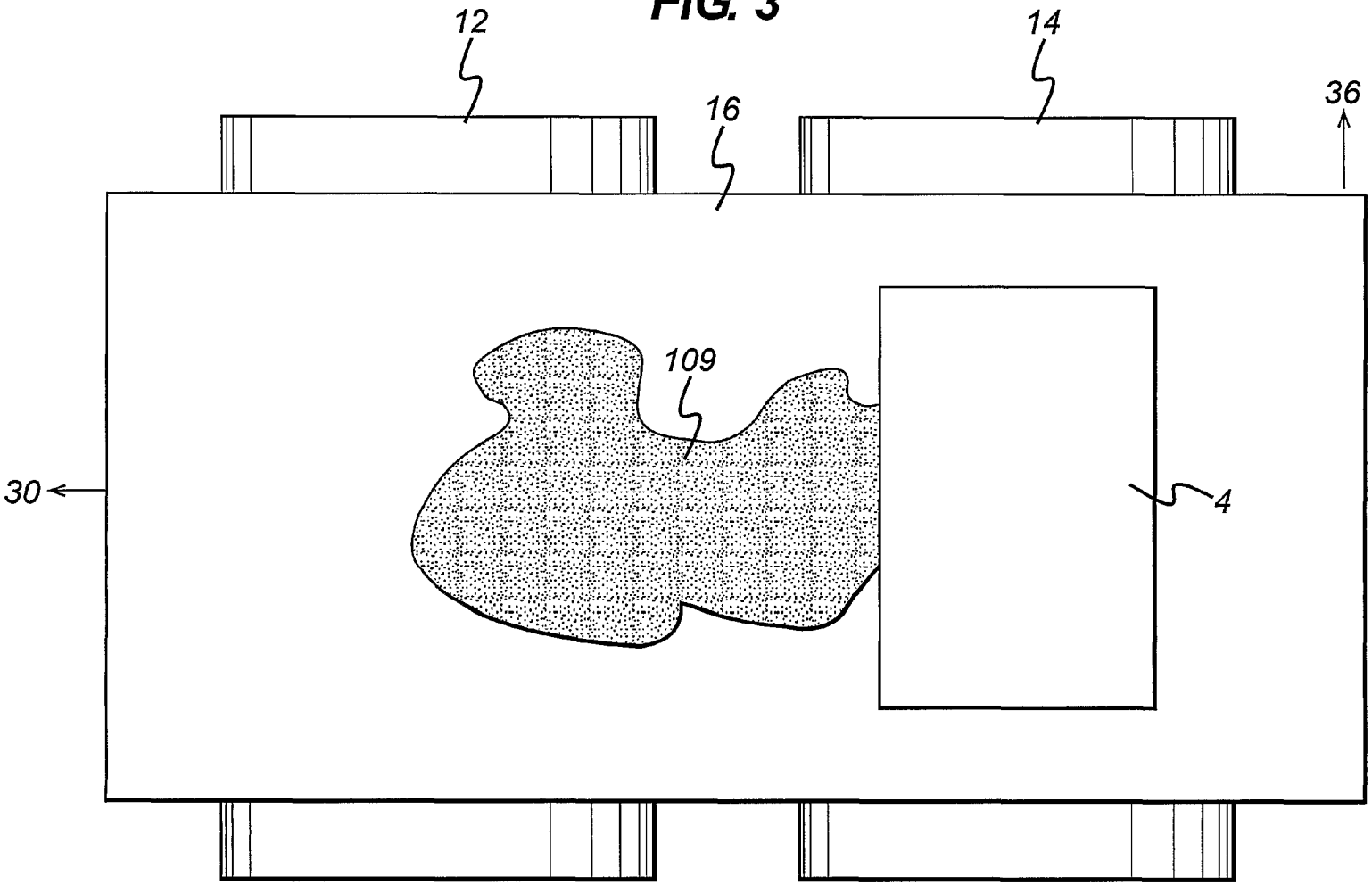
FIG. 3 shows a schematic plan view of a part of the transport system of FIG. 1.
Figure 4:
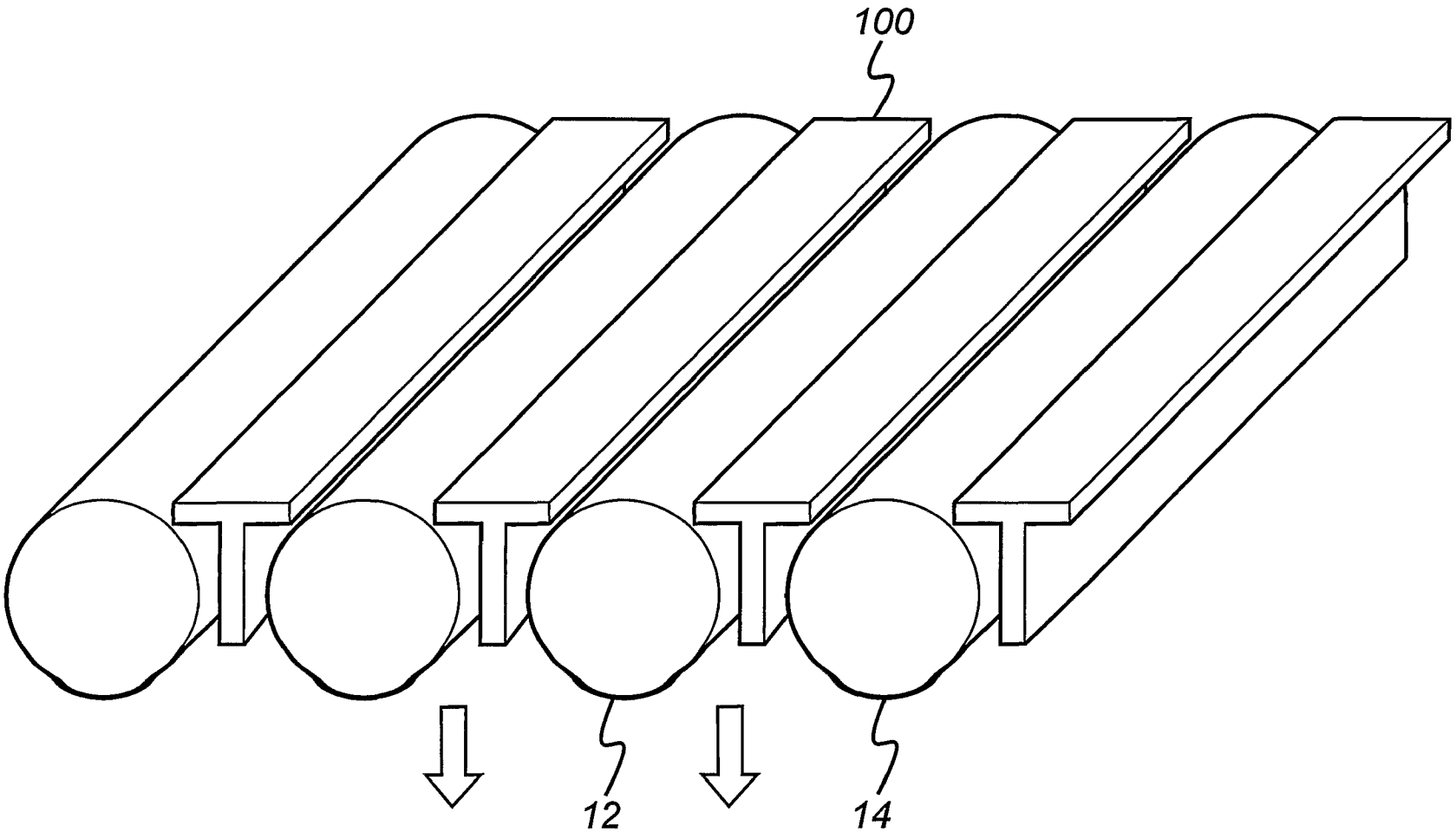
FIG. 4 is a perspective view of a part of the transport system of FIG. 1.

FIGS. 2 and 3 are a schematic side view and plan view, respectively, of a part of the transport system 10. The transport system 10 in this example includes ten cylindrical rollers; only two rollers 12, 14 are shown in FIGS. 2 and 3 for clarity. Four rollers are shown in the perspective view of FIG. 4. The rollers 12, 14 are arranged side by side and in parallel such that there is a uniform separation between the rollers forming a cavity 28 between pairs of adjacent rollers. The substrate 16 is supported on the roller contact surfaces 18, 20.

The transport system 10 moves the substrate 16 in the printing direction 30 (shown as being from right to left in FIG. 3) by rotation of the rollers 12, 14 in an anticlockwise direction 38, 40. Fewer than all of the rollers may be driven, the other rollers being free to rotate. Alternatively, all of the rollers may be driven synchronously by a roller drive system. In this example the arrangement includes a gear train and a single motor to drive all ten rollers, although other arrangements could be used, for example an individual direct drive motor for each roller.

The rollers 12, 14 are rotated in an anticlockwise direction 38, 40 at fixed or variable controlled angular speeds. In this example, the rollers rotate at 300 rpm, giving a linear speed of the substrate over the rollers of just over 1 m/s. The axes of rotation of the rollers are substantially parallel. The velocity of movement of the rollers is substantially equal along the contact surfaces 18, 20 to minimise any unbalanced forces acting on the substrate, as such unbalanced forces could result in undesired lateral movement of the substrate.

The rollers are cylindrical and substantially long in relation to their diameter. The rollers are formed from steel. Other suitably rigid materials could be used, such as plastics or polymer materials, or other metals.

The transport system 10 further includes a pressure system 22, which acts to hold the substrate 16 against the rollers 12, 14 to hold it flat and to reduce slipping of the substrate. The pressure system 22 is arranged to apply a negative gauge pressure 32 to the cavities 28 and hence to the substrate, resulting in the substrate 16 being held against the contact surfaces 18, 20 of the rollers.

Unwanted movement of the substrate 16, in particular in a lateral direction 36 (perpendicular to the print direction 30 in the plane of the substrate 16) can therefore be reduced. Movement of the substrate in the lateral direction can lead to errors in print registration during printing and is therefore highly undesirable.

To reduce lateral movement of the rollers, they are mounted using a deep groove ball bearing at one end of the roller to minimise axial movement of the roller. At the other end, a roller bearing is used to avoid overconstraint.

Figure 5:
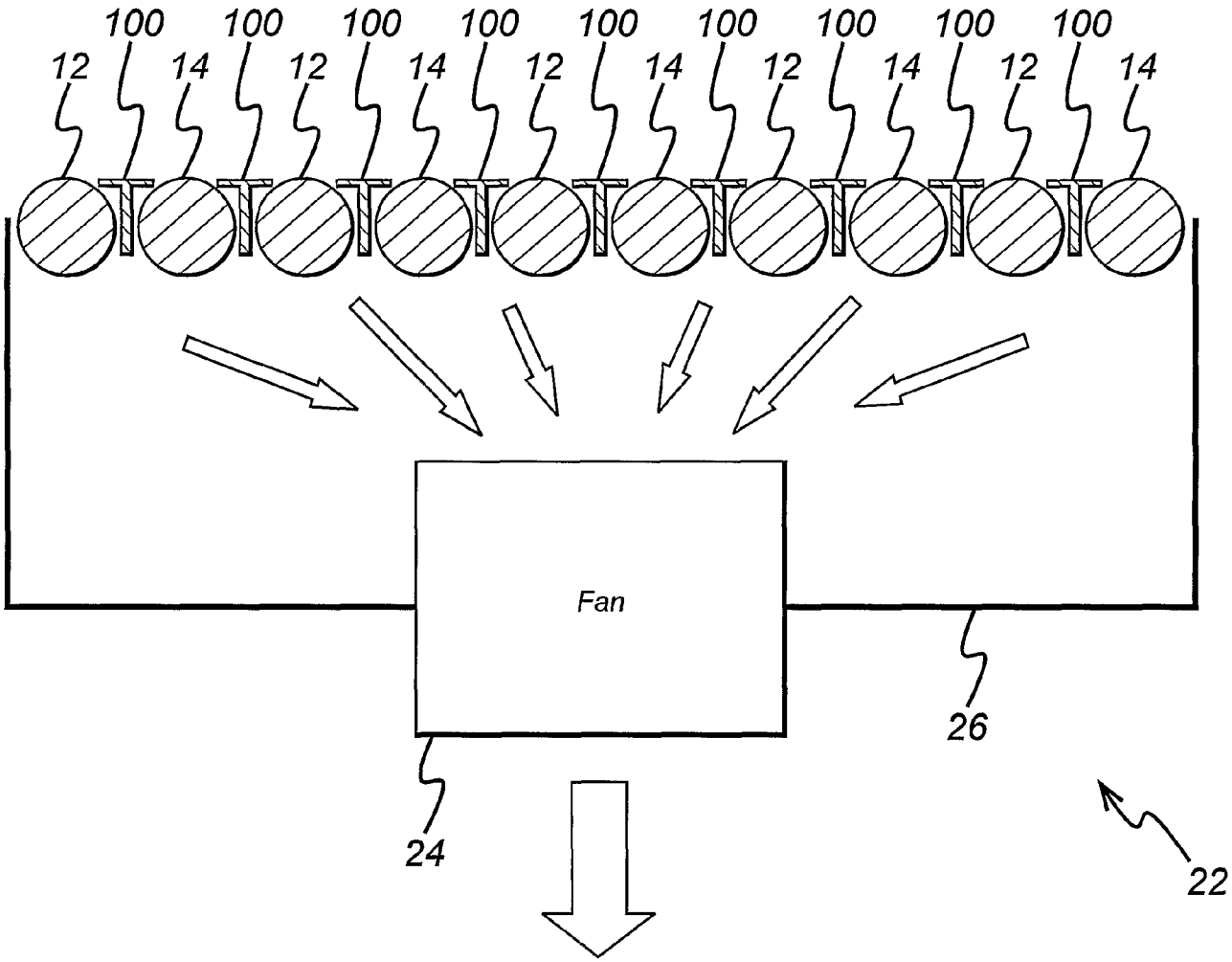
FIG. 5 shows schematically a pressure system of the transport system of FIG. 1.

As shown in FIG. 5, the pressure system 22 includes a fan 24. The system 22 includes a housing 26 which surrounds the lower surfaces of the roller arrangement. A fan 24 is mounted at the base of the housing and is arranged to move air from the housing 26 so as to provide the vacuum at the lower surfaces of the roller arrangement. A Vent-Axia duct fan ACH315-12A was used in this example.

The vacuum applied will be chosen so as to give the desired hold down on the rollers for the particular substrates being printed. In the present example, where the substrate is a 2 mm thick corrugated board, the pressure used is equivalent to 50 mm water.

A mask element 100 is positioned between pairs of adjacent rollers 12, 14. The vacuum intake 26 is provided below the mask element 100. The mask element has various functions: it throttles the airflow caused by the vacuum through the gaps 102 between the mask element and the roller surfaces 18, 20 thereby limiting the size of vacuum pump 24 required; it guides the leading edge of the substrate 16 to help prevent it becoming wrapped around the rollers; it supports the substrate between the rollers, reducing the risk of bending of the substrate. When the substrate is porous, the arrangement of the mask element 100 concentrates the pressure acting on the substrate around the crown of the roller, hence minimising bending of the substrate.

In this example, the mask element 100 is made of stainless steel and has a T-shaped profile. The arms of the element provide a guiding surface for the substrate 16.

In this example, the rollers have a diameter D of 75 mm and adjacent rollers are mounted at a distance A of 100 mm between their axes of rotation. The gap 102 between the arm of the mask element 100 and the roller surface 20 is 1.5 mm.

The flat top surface 104 of mask 100 also provides a guide surface for the leading edge of the substrate as it moves from roller to roller. In this example, the mask element 100 is mounted such that its flat upper surface 104 is at a spacing C of 1.5 mm below the top of the rollers. This reduces the risk of the substrate becoming damaged on the leading edge of the mask element 100.

Figure 6:
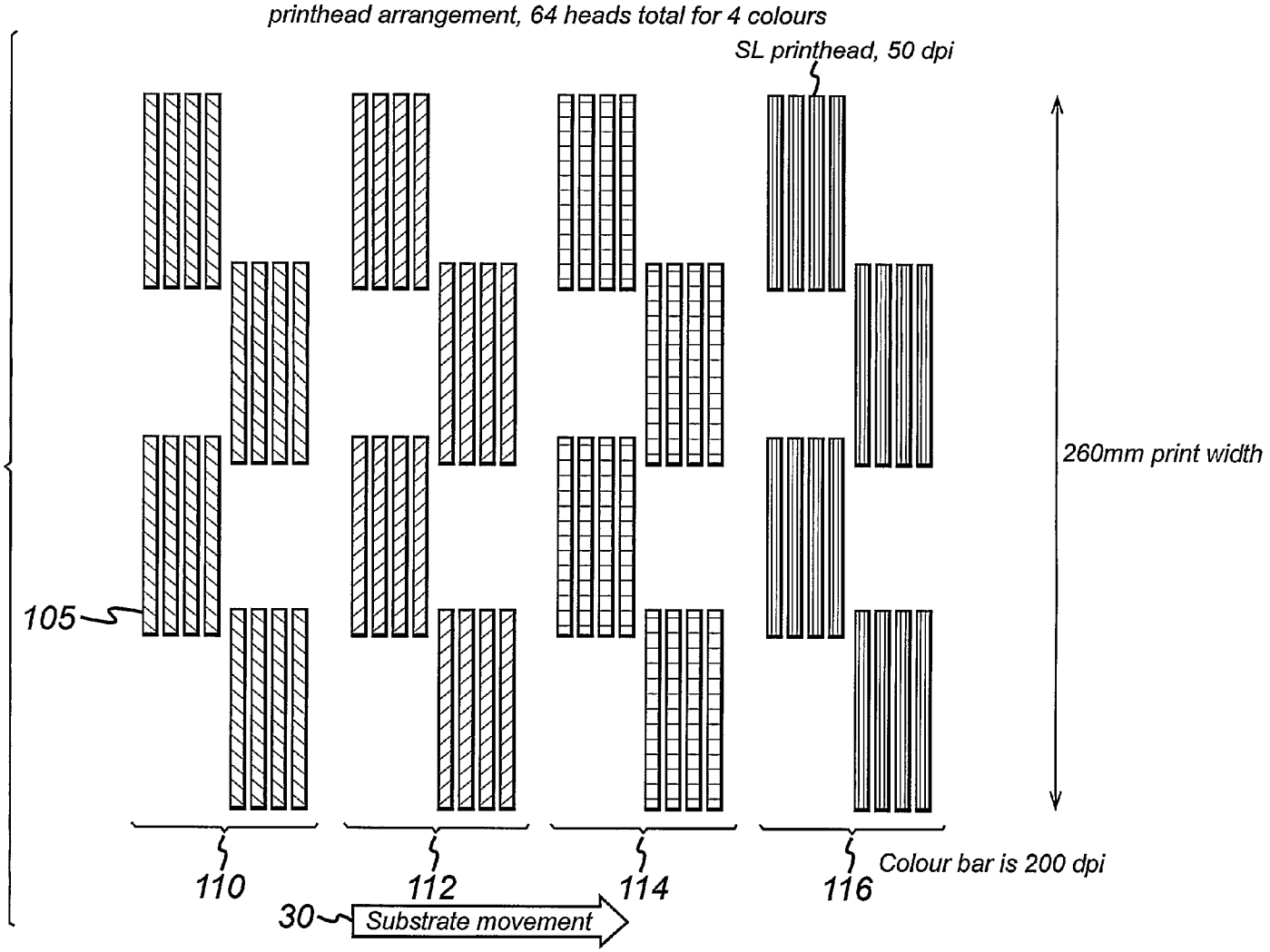
FIG. 6 shows schematically an arrangement of printheads.

FIG. 3 shows an image 109 printed by the printhead arrangement 4. The printhead arrangement 4 shown in FIG. 6 includes 16 printheads 105 of each of cyan 110, magenta 112, yellow 114 and black 116 giving a total of 64 printheads. Groups of four printheads of each colour are arranged side by side so that substantially the whole width of the substrate surface can be printed in a single pass of the substrate. Here, the print width is 260 mm. In this example, the printheads are Spectra SE printheads having a printing resolution of 50 dpi arranged four deep per colour to give a printing addressability of 200 dpi.

The apparatus allows for high quality full colour images to be printed onto substrates in a single pass using an ink jet printer.

It will be understood that the present invention has been described above purely by way of example, and modification of detail can be made within the scope of the invention.

Figure 7:
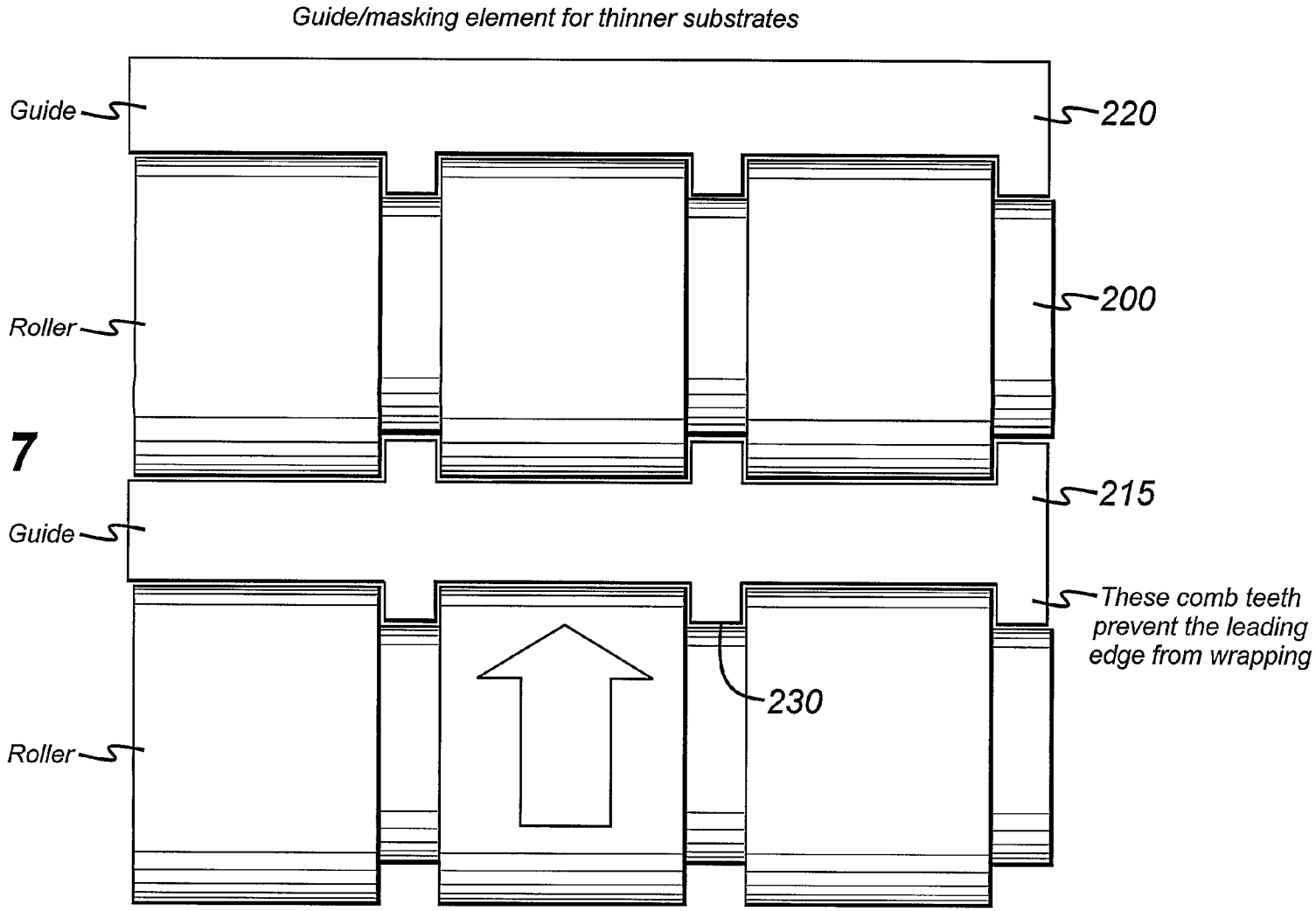
FIG. 7 shows an alternative roller and mask element arrangement.
Figure 8:
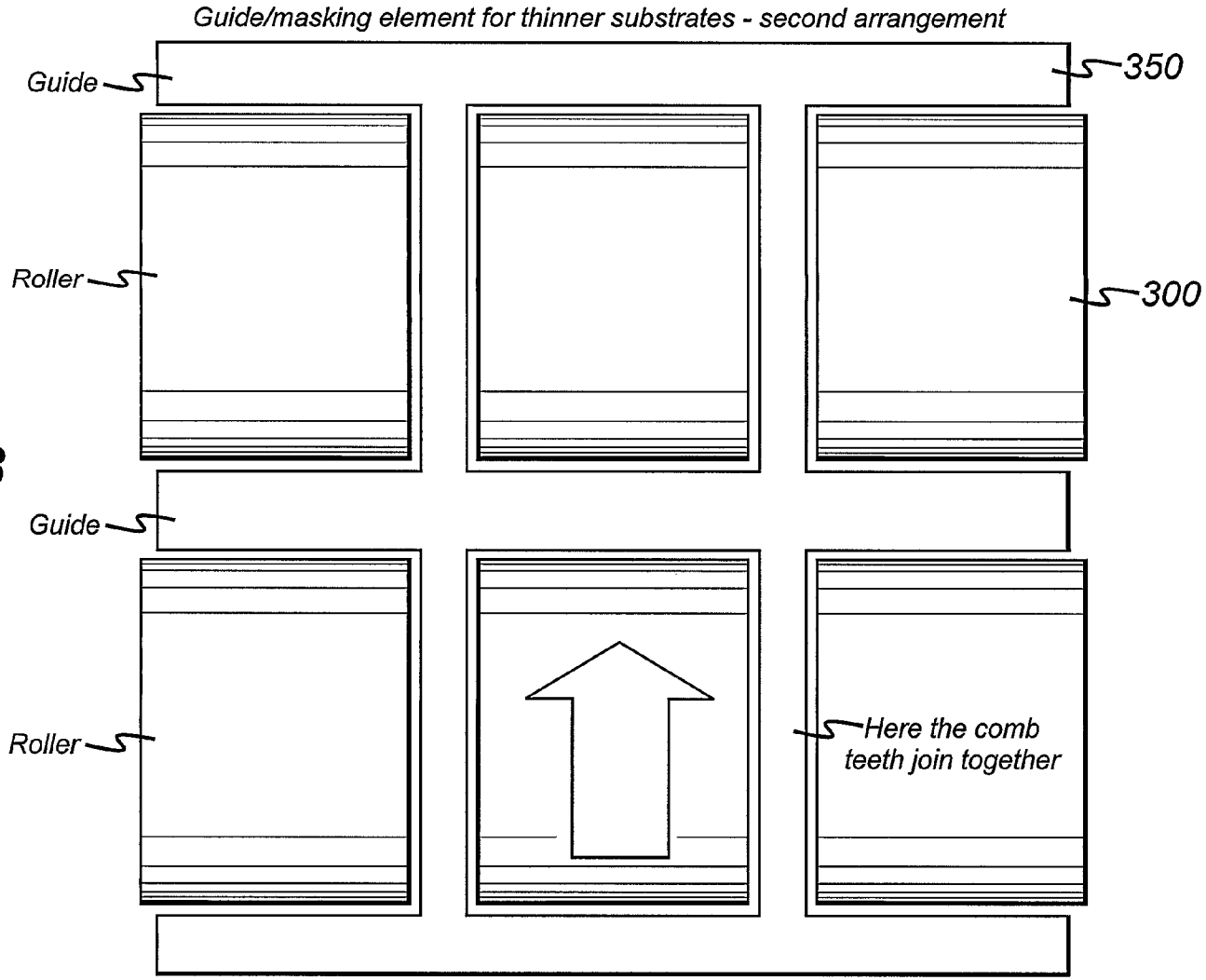
FIG. 8 shows a further alternative roller and mask element arrangement.

For example, where the substrate to be printed has a rigid lower surface, the outer surfaces of the rollers 18, 20 may comprise a deformable material, for example foam or rubber, which on application of the negative gauge pressure to the substrate, deforms to assist the hold down of the substrate onto the rollers.

Where thin flexible substrates are to be printed using the apparatus described above, there is a risk that the substrates can be dragged around a roller and either jam into the gap between the roller and the masking element, or pass straight through into the vacuum plenum. This can limit how thin and flexible a substrate a particular arrangement can handle. FIGS. 7 and 8 show further examples adapted for use particularly with more flexible substrates.

Referring to FIG. 7, the rollers 200 have a non-uniform radius along their length to give a toothed outer surface. The masking/guide elements 215, 220 arranged adjacent the rollers are shaped having teeth 230 corresponding to the regions of reduced radius of the rollers. Thus the leading edge of the masking/guide element is not straight and so there is reduced risk of the substrate passing between the roller and the guide.

FIG. 8 shows a further example where the teeth of the leading edge of the guide/masking element extend to connect with the adjacent guide/masking element to form a guide/masking grid 350 over the rollers 300. This reduces further the risk of the substrate being damaged on the guide/masking element.

It is envisaged that the negative gauge pressure could be applied to the substrate from rollers having an internal vacuum cavity. In this case, substantially hollow rollers could be used, the rollers having a perforated outer skin through which the vacuum is applied.

Each feature disclosed in the description, and (where appropriate) the claims and drawings may be provided independently or in any appropriate combination.

The invention claimed is:

1. An ink jet printing apparatus including a printhead arrangement for printing an image on a substrate in a pass of the substrate past the printhead arrangement in a printing direction, the printer comprising:

a printhead arrangement including a plurality of ink jet printheads for emitting droplets towards a surface of the substrate to form the image, wherein the printhead arrangement extends across substantially the full width of the substrate in a direction perpendicular to the printing direction;

a plurality of rollers arranged to move the substrate past the printheads during the emission of the droplets from the printheads to print the image;

a pressure source arranged to apply a negative gauge pressure to the substrate to hold the substrate to the rollers in the region of the printhead arrangement;

a mask element arranged between first and second rollers of the plurality of rollers such that a first gap is defined between the mask element and the first roller as well as a second gap between the mask element and the second roller, wherein the mask element throttles airflow caused by the negative gauge pressure through the first and second gaps;

wherein the apparatus is adapted to hold the printheads substantially stationary while the image is printed in a pass of the substrate past the printhead arrangement.

2. Apparatus according to claim 1, wherein the apparatus is adapted to print onto the surfaces of a plurality of discrete substrates.

3. Apparatus according to claim 1, wherein the apparatus includes at least three rollers arranged to move the substrate relative to the printheads.

4. Apparatus according to claim 1, wherein a roller is mounted substantially parallel to an adjacent roller such that the angle of the adjacent rollers is not more than 6 milliradians from parallel.

5. Apparatus according to claim 1, where the negative gauge pressure is applied to the substrate in a region between adjacent rollers.

6. Apparatus according to claim 1, wherein the mask element is non-porous and has a T-shaped profile including a top flat surface and a depending portion, the top flat surface providing a guiding surface for the substrate moved by the plurality of rollers, the top flat surface being below and parallel to a plane defined by tops of the first and second rollers, and the depending portion of the mask element extending between the first and second rollers.

7. Apparatus according to claim 6, wherein the element is arranged to restrict the airflow between the rollers.

8. Apparatus according to claim 6, wherein the element is arranged to reduce deformation of the substrate between the rollers.

9. Apparatus according to claim 1, further including a guide for guiding a leading edge of the substrate.

10. Apparatus according to claim 1, wherein the substrate comprises a substantially rigid material.

11. Apparatus according to claim 1, wherein the arrangement is such that the substrate is mounted, during printing, on a deformable surface.

12. Apparatus according to claim 1, wherein the apparatus is adapted to move the substrate at a speed greater than 1 m/s.

13. Apparatus according to claim 1, wherein the system is adapted to print a colour image.

14. Apparatus according to claim 1, wherein the apparatus is adapted to print an image having a resolution of greater than 120 dpi.

15. A method of printing a substrate in an ink jet printer comprising a printhead arrangement, a plurality of rollers and a pressure source, the method comprising the steps of:

moving the substrate on the rollers past the printheads in a printing direction, of printheads that extend at least the full width of the image to be printed in a direction perpendicular to the printing direction;

applying a negative gauge pressure to the substrate to hold the substrate to the rollers in the region of the printhead arrangement and primarily throttling airflow caused by the negative gauge pressure through first and second gaps defined by first and second rollers of the plurality of rollers and a mask element arranged therebetween, wherein the first gap is positioned between the mask element and the first roller as well as the second gap is positioned between the mask element and the second roller;

emitting droplets from the printheads towards the substrate during the movement of the substrate past the printhead arrangement such that the image is printed onto the substrate in one pass of the substrate past the printhead arrangement; and holding the printheads substantially stationary during the printing of the image on the substrate.

16. Apparatus according to claim 6, wherein the element is arranged to be spaced apart from the substrate.

17. Apparatus according to claim 1, wherein the rollers are substantially non-porous.

18. Apparatus according to claim 1, wherein the arrangement is such that no roller is arranged so as to contact the surface of the substrate to be printed.

19. Apparatus according to claim 1, wherein the printheads are arranged directly adjacent to a roller for emitting ink onto a region of the substrate in contact with the roller.

20. An ink jet printing apparatus comprising:

a printhead arrangement for printing an image on a substrate, wherein the printhead arrangement includes a plurality of ink jet printheads for emitting droplets towards a surface of the substrate to form the image, wherein the apparatus is adapted to hold the printheads substantially stationary while ink is emitted towards the substrate and the substrate is moved past the printheads;

a transport device for moving the substrate through an ink jet printer, the device comprising a plurality of substrate support elements for supporting the substrate in the printer, the support elements including a plurality of rollers arranged to move the substrate past the printheads during emission of droplets on the substrate, wherein the support elements of the transport device are all substantially aligned so that the path of the substrate through the printer is substantially planar, the transport device further including a pressure source wherein the pressure source is arranged to apply a negative gauge pressure to the substrate to hold the substrate to the rollers in the region of the printheads;

a mask element arranged between first and second rollers of the plurality of rollers such that a first gap is positioned between the mask element and the first roller as well as a second gap is positioned between the mask element and the second roller, wherein the mask element throttles airflow caused by the negative gauge pressure through the first and second gaps.

21. A method of printing onto a substantially rigid substrate using an ink jet printing apparatus including a printhead arrangement for printing an image on the substrate, and a transport device including a plurality of rollers and a pressure source, the method including:

moving the substrate into the printer and onto the rollers;

moving the substrate on the rollers past the printhead arrangement during printing;

applying a negative gauge pressure to the substrate to hold the substrate to the rollers in the region of the printhead arrangement and throttling airflow caused by the negative gauge pressure through first and second gaps defined by first and second rollers of the plurality of rollers and a mask element arranged therebetween, wherein the first gap is positioned between the mask element and the first roller as well as the second gap is positioned between the mask element and the second roller; and emitting droplets from printheads of the printhead arrangement to deposit the droplets on the substrate, the printheads being held substantially stationary while ink is emitted towards the substrate and the substrate is moved past the printheads, wherein the path of the substrate through the printer is substantially planar.

* * * * *